US007264604B1

(12) United States Patent
Schuren et al.

(10) Patent No.: US 7,264,604 B1
(45) Date of Patent: Sep. 4, 2007

(54) CURABLE OFF-LOADING FOOTWEAR AND METHODS

(75) Inventors: Johannes Schuren, Linne (NL); Kurt Allenberg, Woodbury, MN (US); Andrew Joseph Callinan, Shoreview, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 690 days.

(21) Appl. No.: 09/693,770

(22) Filed: Oct. 20, 2000

(51) Int. Cl.
*A61F 5/00* (2006.01)

(52) U.S. Cl. ..... 602/8; 602/23; 602/61

(58) Field of Classification Search ..... 602/62, 602/5, 8, 27, 61, 23; 36/145, 154, 166, 266, 36/173

See application file for complete search history.

(56) References Cited

U.S. PATENT DOCUMENTS

| | | | | |
|---|---|---|---|---|
| 3,834,047 A | | 9/1974 | Schenker | |
| 3,895,405 A | | 7/1975 | Edwards | |
| 4,237,626 A | * | 12/1980 | Brown | 36/43 |
| 4,674,205 A | * | 6/1987 | Anger | 36/44 |
| 4,683,877 A | | 8/1987 | Ersfeld et al. | |
| 4,888,225 A | | 12/1989 | Sandvig et al. | |
| 4,946,726 A | | 8/1990 | Sandvig et al. | |
| 5,002,047 A | | 3/1991 | Sandvig et al. | |
| 5,195,945 A | | 3/1993 | Sandvig et al. | |
| 5,203,764 A | | 4/1993 | Libbey et al. | |
| 5,324,252 A | | 6/1994 | Libbey et al. | |
| 5,359,791 A | | 11/1994 | Prahl et al. | |
| 5,553,399 A | * | 9/1996 | Strong | 36/9 R |
| 5,718,064 A | * | 2/1998 | Pyle | 36/28 |
| 5,787,608 A | * | 8/1998 | Greenawalt | 36/11.5 |
| 6,601,320 B1 | * | 8/2003 | Brown | 36/25 R |
| 2002/0050080 A1 | * | 5/2002 | Vasyli | 36/145 |

FOREIGN PATENT DOCUMENTS

| | | |
|---|---|---|
| EP | 0 592 734 | 4/1994 |
| FR | 2 581 536 | 5/1985 |
| FR | 2 781 651 | 7/1998 |
| WO | WO 00/25616 | 5/2000 |

OTHER PUBLICATIONS

American Academy of Family Physicians, "The Total Contact Cast: What It Is and Why It's Used," Patient Information Brochure, 2 pages, (Feb. 1997).

Caputo et al., "The Total Contact Cast: A Method for Treating Neuropathic Diabetic Ulcers," *American Family Physician,* vol. 55(2), pp. 605-611 (Feb. 1, 1997).

Glod et al., "A Comparison of Weightbearing Pressures in Various Postoperative Devices," *The Journal of Foot and Ankle Surgery,* vol. 35(2), pp. 149-154 (1996).

Myerson et al., "The Total-Contact Cast for Msnagement of Neuropathic Plantar Ulceration of the Foot," *The Journal of Bone and Joint Surgery, Incorporated,* vol. 74-A(2), pp. 261-269, (Feb. 1992).

* cited by examiner

*Primary Examiner*—Michael A. Brown
(74) *Attorney, Agent, or Firm*—Nancy M. Lambert

(57) ABSTRACT

Custom footbed devices, methods of constructing the devices and kits for constructing custom footbeds are disclosed that may be particularly advantageous in the treatment of plantar ulcers. The devices offer the advantage of off-loading pressure from the plantar ulcers in a device that is easy to construct, reusable, lightweight, and custom-made to improve patient comfort. The footbeds are constructed using a curable substrate that is formed to the plantar surface of the foot except in the areas occupied by spacers designed to off-load wounds on the bottom of the foot.

18 Claims, 3 Drawing Sheets

CURABLE OFF-LOADING FOOTWEAR AND METHODS

FIELD OF THE INVENTION

The present invention relates to the field of curable orthopedic devices. More particularly, the present invention relates to custom footbeds along with kits and methods of constructing the same.

BACKGROUND

Plantar ulcers, i.e., ulcers located on the bottom of the foot, are a source of concern for many diabetic patients. The ulcers are often caused by continuous elevated pressure that may be the result of, e.g., abnormal gait pattern, foot deformity, a foreign object, etc. The problem is made more acute by the loss of protective sensation and may be exacerbated by reduced blood flow found in the extremities of some diabetic patients.

Attempts to address the problem of plantar ulcers focus on off-loading the affected areas such that the pressure on the ulcerated area is reduced or eliminated during ambulatory activity. One of the most effective approaches involves the use of a total contact cast that mechanically unloads the affected area by providing a rigid cast extending from below the knee and including the patient's foot. The goal in forming a total contact cast is to shape the cast such that the ulcerated area experiences reduced pressure during ambulation by the patient.

Total contact casts do, however, suffer from a number of disadvantages. Among the disadvantages are the cost of total contact casting. The course of treatment for a plantar ulcer often extends for a period of about ten weeks. The ulcer must be monitored for healing, infection, etc. at least once per week. That monitoring requires removal of the cast and refashioning of a new total contact cast at each visit. In addition to cost, other disadvantages include inconvenience for the patient, as the length of each office visit is increased by the time required to fashion a new cast. Furthermore, the skill level of the cast technicians needed to fashion a total contact cast is high, limiting the availability of total contact casts to those patients with access to highly skilled medical personnel.

Other approaches to treating plantar ulcers involve the use of pre-made walkers. Some of these devices may include customizable insoles and/or air bladders to improve fit. The devices tend, however, to be bulky and uncomfortable to wear. In addition, because the devices are easily removed and replaced by the wearer, patient compliance with treatment plans is difficult to control and/or monitor. These problems are exacerbated by the bulkiness and discomfort of the devices. Further, clinical evidence of the efficacy of such devices in the treatment of plantar ulcers is obscure.

SUMMARY OF THE INVENTION

The present invention provides footbed devices, methods of constructing the devices and kits for constructing custom footbeds that may be particularly advantageous in the treatment of plantar ulcers. The devices offer the advantage of off-loading pressure from the plantar ulcers in a device that is easy to construct, reusable, lightweight, and custom-made to improve patient comfort.

The custom footbed may provide for the reduction or elimination of existing pressure points, i.e., areas of increased pressure, on the plantar surface of the foot during ambulation. It is further preferred that the footbeds do not create new pressure points while addressing the existing ones.

In one aspect, the present invention provides a custom footbed for a foot, the footbed including a substrate having an upper surface formed to the contour of only a portion of the plantar surface of the foot; and a depression occupying a selected area of the upper surface of the substrate, wherein the upper surface of the substrate deviates from the contour of the plantar surface of the foot within the selected area occupied by the depression, and whereby the depression and the foot define a cavity. A compressible wound spacer may or may not be located within the depression.

In another aspect, the present invention provides a method of constructing a custom footbed by providing a curable substrate including curable material; providing a compressible surface; providing a wound spacer; locating the curable substrate on the compressible surface; positioning the wound spacer at a selected location between a foot and the substrate; forming the curable substrate to the contour of a portion of the plantar surface of the foot, wherein the curable substrate deviates from the contour of the plantar surface of the foot within the selected location occupied by the wound spacer; and curing the substrate after forming.

In another aspect, the present invention provides a custom footbed kit including a compressible article having a compressible surface; a wound spacer; toe spacer material; and a package containing the compressible article, the wound spacer, and the toe spacer material.

In another aspect, the present invention provides a custom footbed kit including a compressible article having a compressible surface; a wound spacer; and directions for constructing a custom footbed. The directions include instructions to locate a curable substrate on the compressible surface; position the wound spacer at a selected location between a foot and the curable substrate; form the curable substrate to the contour of a portion of the plantar surface of the foot, wherein the curable substrate deviates from the contour of the plantar surface of the foot within the selected location occupied by the wound spacer; and cure the curable substrate after forming the curable substrate.

In another aspect, the present invention provides a custom footbed kit including a compressible article having a compressible surface; a wound spacer; toe spacer material; and the directions for constructing a custom footbed. The directions include instructions to locate a curable substrate on the compressible surface, wherein the curable substrate includes moisture curable resin; position the wound spacer at a selected location between a foot and the curable substrate, wherein the wound spacer is in contact with the curable substrate; locate the toe spacer material between the toes of the foot and the curable substrate; form the curable substrate to the contour of a portion of the plantar surface of the foot, wherein the curable substrate deviates from the contour of the plantar surface of the foot within the selected location occupied by the would spacer; and cure the curable substrate after forming, wherein the wound spacer is retained on the substrate after curing.

These and other features and advantages of the invention are described below in connection with various illustrative embodiments of the invention.

DETAILED DESCRIPTION OF ILLUSTRATIVE EMBODIMENTS OF THE INVENTION

The present invention provides custom footbeds, methods of constructing the footbeds, and kits for constructing the footbeds. The custom footbeds may be particularly helpful in the treatment of plantar ulcers because of their ability to reduce the pressure applied to those areas during ambulation by a patient.

Figure 1:
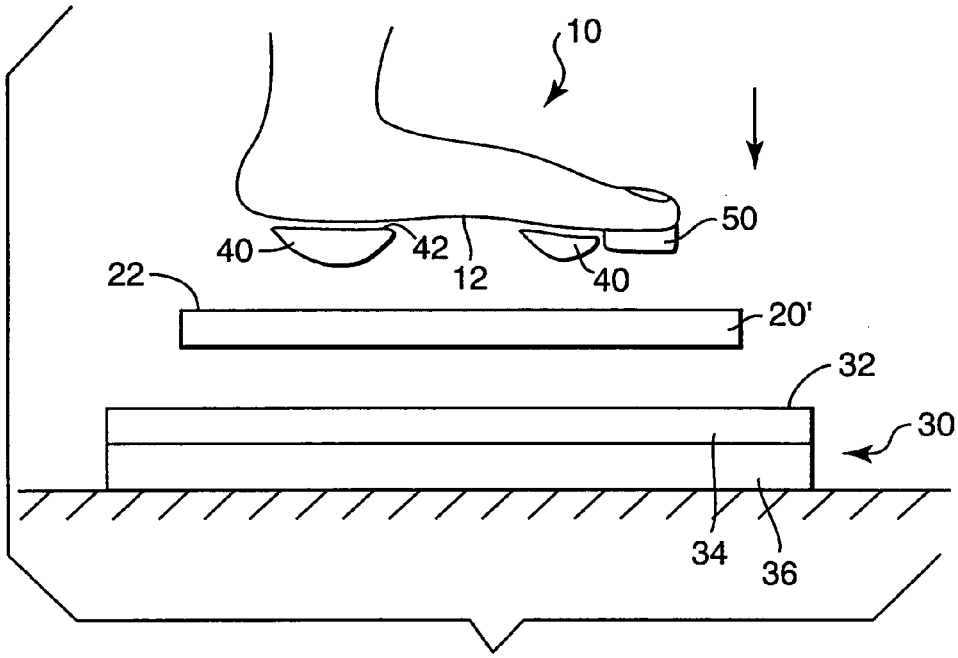
FIG. 1 depicts one method of constructing a custom footbed according to the present invention.
Figure 2:
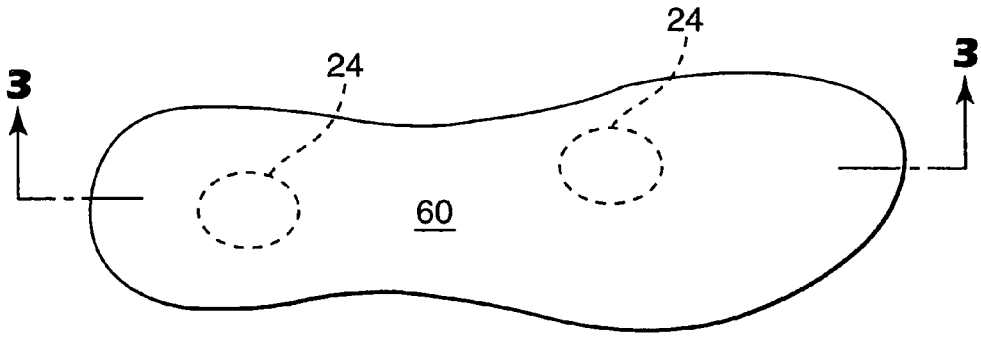
FIG. 2 is a view of the upper surface of one custom footbed according to the present invention.
Figure 3:
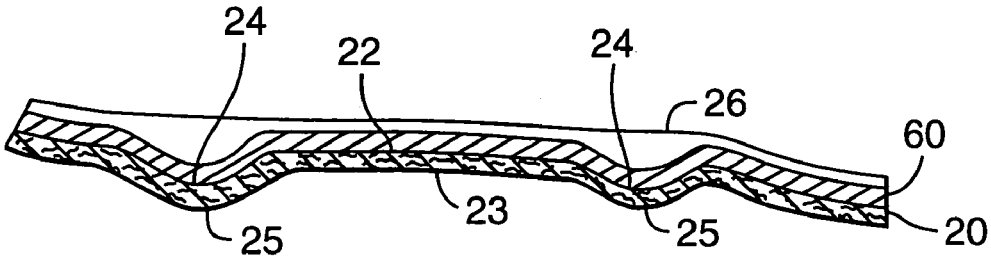
FIG. 3 is a cross-sectional view of the footbed of FIG. 2, taken along line 3-3 in FIG. 2.

FIG. 1 illustrates one method of constructing a custom footbed according to the present invention. FIGS. 2 and 3 depict a finished custom footbed that may be constructed using the method depicted in FIG. 1 (or variations thereof).

The custom footbed depicted in FIGS. 2 and 3 includes a cured substrate 20 including depressions 24 formed in the upper surface 22 thereof. The cured substrate 20 is formed to the contour of a portion of the plantar surface 12 of the foot 10. The perimeter of the custom footbed preferably rises around the outside of the foot, forming a gutter 26 that may help retain the foot in position relative to the substrate 20.

It will typically be preferred that the cured substrate 20 conform to the contour of a major portion of the plantar surface of the foot. It may be preferred that the cured substrate 20 deviates from the foot contour only in the areas where the depressions 24 are found, as well as in the area of the toes.

It is preferred that cured substrate 20 extend over the entire length and width of the plantar surface 12 of the foot 10, including the toes. Terminating the substrate 20 short of, e.g., the toes, may create new pressure points that could lead to the creation of additional plantar ulcers.

Also included in the footbed is a contact layer 60 attached to the upper surface 22 of the substrate 20, preferably after curing. The contact layer 60 may improve patient comfort by cushioning the otherwise rigid upper surface 22 of the substrate 20. It may be preferred that the contact layer 60 be attached to the substrate 20 by an adhesive, e.g., a pressure-sensitive adhesive. Although the contact layer 60 is depicted as conforming to the upper surface 22 even within depressions 24, the contact layer may alternatively bridge the depressions 24.

The contact layer 60 may be provided of any suitable material. It may be preferred, however, that the contact layer 60 possess one or more of the following properties: high moisture-permeability, hydrophobicity, compressibility, shear reducing, etc. It may be particularly preferred that the contact layer be shear-reducing, i.e., that the contact layer 60 absorb some of the shear forces produced as the foot moves relative to the footbed. One suitable shear-reducing material is, e.g., a three-dimensional knit fabric (Type MSHR 747/1, 100% polyester, from Gehring Textiles, New York).

The method, as depicted in FIG. 1, involves the use of a curable substrate 20' that is formed to the contour of the plantar surface 12 of the foot 10. The forming involves pressing the plantar surface 12 of the foot 10 against the curable substrate 20' while it is supported by a compressible surface 32 (provided in FIG. 1 by compressible article 30). During forming, wound spacers 40 and a toe spacer 50 are positioned between the foot 10 and the curable substrate 20' to provide the desired shape to the substrate 20' during curing.

The curable substrate 20' may take a variety of forms. By "curable" it is meant that the substrate 20' can be formed to the contour of the plantar surface 12 of the foot 10, followed by curing to form a self-supporting shape. The term "curing" is used herein to refer to reactive systems that irreversibly solidify upon the application of heat and/or other sources of energy, such as E-beam, ultraviolet, visible, etc., or with time upon the addition of a chemical catalyst, moisture, and the like. The irreversible solidification may involve polymerization, crosslinking, or both.

It may be preferred that the curable substrate be provided as the combination of a moisture-curable resin carried by a supporting layer. Examples of curable materials that include a moisture-curable resin and a support layer are described in U.S. Pat. No. 4,502,479 (Garwood et al.); U.S. Pat. No. 4,683,877 (Ersfeld et al.); U.S. Pat. No. 4,968,542 (Gasper et al.); U.S. Pat. No. 5,354,259 (Scholz et al.); U.S. Pat. No. 5,423,735 (Callinan et al.); U.S. Pat. No. 5,593,628 (Scholz et al.); U.S. Pat. No. 5,976,610 (Scholz et al.); U.S. Pat. No. 5,997,492 (Delmore et al.); and U.S. Pat. No. 6,030,355 (Callinan et al.).

The number of layers of the resin-filled splinting/casting materials and their shape or shapes may be varied to provide the desired strength to the finished footbed 20. One suitable curable substrate 20' may be, e.g., ten layers of SCOTCH-CAST PLUS casting tape (Minnesota Mining and Manufacturing Company, St. Paul, Minn.).

In many cases, it may be preferred that the cured substrate 20 be substantially rigid. As used in connection with the present invention, "rigid" means that the substrate exhibits virtually no deformation when subjected to the forces of normal human ambulation.

It may be preferred that the curable substrate 20' include a moisture-curable resin impregnated in a textile. As used herein, "textile" includes one or more layers of a knit, woven, and/or nonwoven fabric. It may further be preferred that the curable substrate 20' be relatively incompressible such that during forming the substrate 20' maintains a substantially uniform layer thickness over substantially the entire footbed (as opposed to resin-impregnated foams that compress during forming and curing, resulting in a non-uniform layer thickness).

It may also be preferred that the substrate 20 be porous after curing to allow moisture vapor escaping from the skin beneath the footbed to escape. For curable materials that include a moisture-curable resin and support layer, it may be preferred that the support layer provide pores such that after the resin cures, moisture vapor can pass through the cured substrate 20.

As discussed above, at least one wound spacer 40 (two of which are depicted in FIG. 1) is located between the plantar surface 12 of the foot 10 and the curable substrate 20' to form depressions in the upper surface 22 of the curable substrate 20' during forming that are retained after the substrate 20' is cured into a rigid shape. The wound spacers 40 are positioned in selected locations relative to the plantar surface 12. In many cases the selected locations will correspond to a plantar ulcer or other wound.

The wound spacers 40 may be attached to the foot 10. As used herein, "attached to the foot" means that the wound spacers 40 are fixed in a selected location on the foot 10. The wound spacers 40 may be attached directly to the plantar surface 12 of the foot or to a covering that is located over the foot 10, e.g., a stockinet, bandage, wrapping, etc. Alternatively, the wound spacers 40 may be positioned on the curable substrate 20' rather than being attached to the foot 10. In some instances the wound spacers 40 will not be in contact with the curable substrate 20' during curing. As a result, they may be removed from the substrate after curing. In another alternative, the wound spacers 40 may be attached to the substrate 20 after cured by some other technique, e.g., adhesives, etc. If the wound spacers 40 are, however, in contact with the curable substrate 20' during curing, they may be attached, and remain attached, to the footbed after curing. Alternatively, the wound spacers 40 may be removed from the cured footbed if so desired.

The wound spacers 40 may take a variety of forms. Typically, however, the wound spacers 40 should be manufactured of a material that is less compressible than the compressible surface. Suitable materials for the wound spacers 40 may be, e.g., R-4911-T foam (from Rubatex Corporation, Bedford, Va.).

This relative compressibility can be expressed in terms of "compression modulus" which, as used herein, refers to the force required to produce a unit of compression in the referenced material. In other words modulus equals force/compression. Thus, a material with a higher compression modulus is less compressible than a material with a lower compression modulus because a larger force would be required to produce the same compression in the two materials.

As a result, it may be preferred that the wound spacers 40 be manufactured of materials that have a higher compression modulus than the compressible surface 32. Wound spacers 40 with a higher compression modulus will cause deformation of the compressible surface 32 (and the curable substrate 20' located therebetween) when pressed together. To enhance the formation of depression 24, the curable substrate 20' should have a higher compression modulus than both the wound spacer 40 and the compressible surface 32. It may be preferred that the difference in compression moduli be such that the curable substrate 20' be substantially incompressible as compared to the wound spacers 40 and compressible surface 32 (i.e., that both the wound spacer 40 and the compressible surface 32 would reach or approach their respective maximum compression before any significant compression would be caused in the curable substrate 20').

Regardless of the actual compression modulus relationships between the wound spacer 40, curable substrate 20', and compressible surface 32, the desired result is that a depression 24 be formed in the upper surface 22 of the cured substrate 20. As depicted in FIG. 3, the depression 24 in the upper surface 22 of the curable substrate 20' may cause a corresponding protrusion 25 on the bottom surface 23 of the substrate 20'. This may be particularly true if the curable substrate 20' has a higher compression modulus than both the wound spacer 40 and the compressible surface 32.

The depression 24 thus formed by each wound spacer 40 defines a cavity between the plantar surface 12 of the foot 10 when the cured substrate 20 is used in a footbed. That cavity provides for the off-loading of pressure on the foot in those areas. The cavities may or may not be occupied by the wound spacers 40 used to create them during construction of the footbed.

Other optional features of the wound spacers 40 include their shape. For example, it may be preferred that the wound spacers 40 include tapered edges 42 as illustrated in FIG. 1 such that any depression they form in the curable substrate 20' proceeds gradually to a maximum depth. That gradual nature of the depression may reduce the chance of producing a new pressure point on the plantar surface 12 of the foot 10 when using the cured substrate 20 in a footbed.

The depths of the different depressions 24 may be controlled in a variety of manners. For example, the compression moduli of the materials used in the wound spacers 40 may be selected to provide a deeper or shallower depression, the uncompressed thickness of the spacers 40 may be varied, the compression modulus of the compressible surface 32 may be varied, etc.

A toe spacer 50 is preferably provided between the curable substrate 20' and the toes of the foot 10 such that the substrate 20' does not conform to the contours of the plantar surface of the toes. It may typically be preferred that the compression modulus of the toe spacer 50 be greater than the compression modulus of the compressible surface 32 to force the substrate 20' away from close conformance to the toes of the foot 10 during forming of the curable substrate 20'. Suitable material for the toe spacer 50 may be, e.g., 0.25 inch (6 mm) thick RESTON foam (Minnesota Mining and Manufacturing Company, St. Paul, Minn.).

The compressible surface 32 may preferably be provided on a compressible article 30 that is in the form of a pad or mat as depicted in FIG. 1. It may further be preferred that the article 30 include layers with different compression moduli. For example, the illustrated article 30 includes two layers 34 and 36, with the upper layer 34 forming the compressible surface 32. In such a design, it is typically preferred that the upper layer 34 have a lower compression modulus than the base layer 36. Rather than distinct layers 34 and 36, the article 30 may be provided with a gradually varying modulus of compression that increases when moving from the compressible surface 32 downward. One suitable article 30 may be provided using 1 inch (25 mm) thick sheets of foam adhered to each other (e.g., E-270 and E-550 available from Illbruck Inc., Minneapolis, Minn.).

Figure 4:
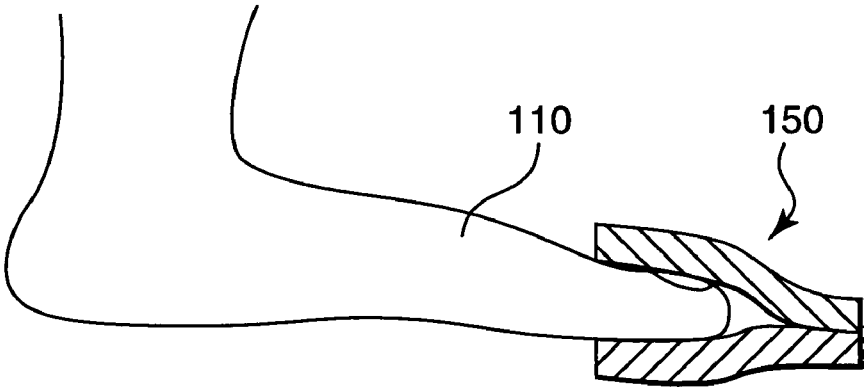
FIG. 4 is a view of one method of using a toe spacer according to the present invention.

FIG. 4 depicts an alternate toe spacer 150 in cross-section that is provided in the form of an envelope into which the toes are inserted. Such a design may help to maintain the position of the toe spacer 150 on the foot 110. Furthermore, if the custom footbed is to be retained against the foot by a removable boot as described below, the portion of the toe spacer 150 located above the toes provides desired spacing of that boot from the toes to improve patient comfort.

Figure 5:
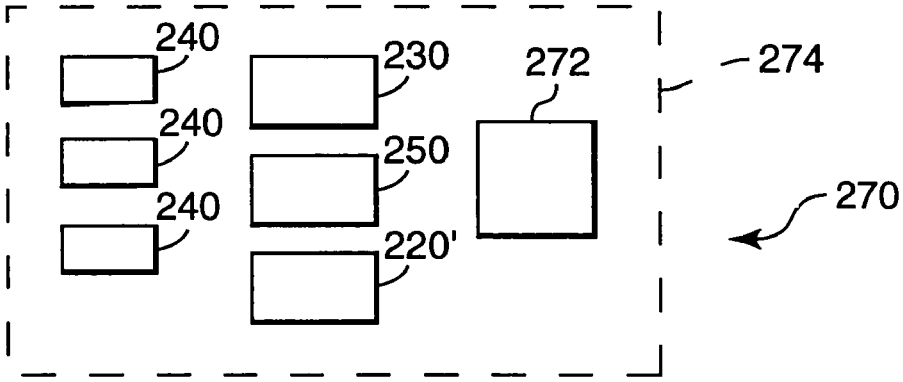
FIG. 5 is a block diagram illustrating the components in one kit according to the present invention.

FIG. 5 is a block diagram depicting the components that may be included in kits for constructing custom footbeds according to the present invention. The kit 270 may include, for example, an optional curable substrate 220', a compressible article 230, at least one wound spacer 240 (three of which are included in kit 270), optional toe spacer material 250, and optional directions 272. The components of the kit 270 may be provided in a package 274.

The package 274 may, for example, take the form of a box, with the compressible article 230 in the form of a foam article located within the lid of the box. When used, the lid of the box may be removed and placed with the compressible article facing upward, thereby providing the compressible surface used to preferably form the curable footbed as described herein.

The directions 272 may include a variety of instructions for performing the methods of constructing custom footbeds according to the present invention. Examples of some instructions can be derived from the description of the method as described in this document.

The directions 272 may be provided in any of one or more suitable formats. For example, they may be printed in a brochure or other small format, printed in a larger format (e.g., a wall chart), provided in video format (e.g., on videotape). The directions may also be provided electronically, e.g., over the Internet or on a data storage device (e.g., disk, CD-ROM, DVD, tape, etc.) provided with the kit 270. The directions 272 are an optional component of the kit 270 because the medical personnel may obtain the directions 272 outside of the kit 270 and retain them for use with a plurality of kits 270.

It may be preferred to make the curable substrate 220' an optional component of the kit 270 because, for example, if the kit includes a curable substrate 220' including moisture-curable resin, that product may prematurely cure if its own packaging allows moisture penetration. Such premature curing may render the entire kit 270 useless because of the lack of a curable substrate 220'.

Toe spacer material 250 may also be optionally provided in the kit 270 because it may be possible for the medical personnel using the kit to employ materials they have on hand in place of a dedicated piece of toe spacer material 250.

Figure 6:
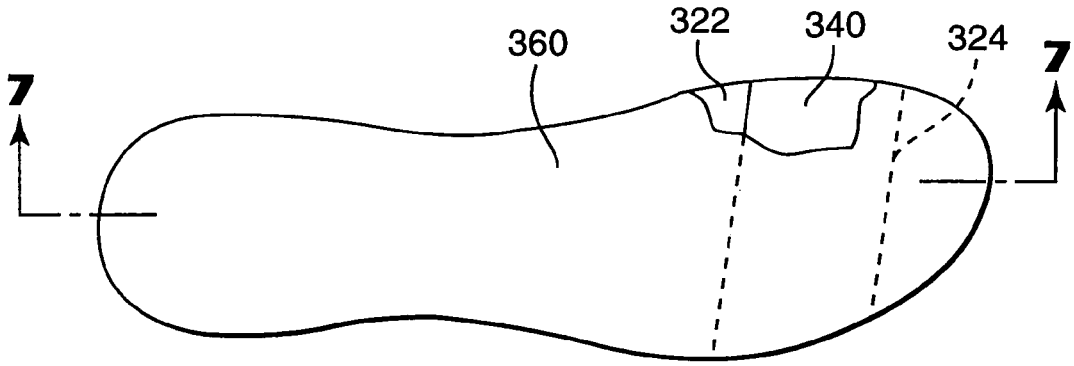
FIG. 6 is a view of the upper surface of another custom footbed according to the present invention.
Figure 7:
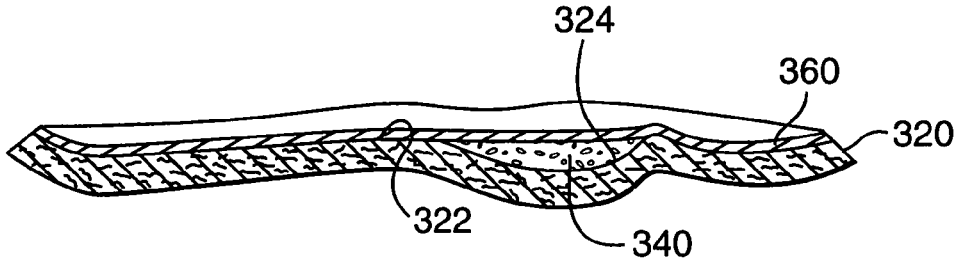
FIG. 7 is a cross-sectional view of the footbed of FIG. 6, taken along line 7-7 in FIG. 6.

Referring now to FIGS. 6 and 7, another custom footbed is depicted that includes a rigid substrate 320 having an upper surface 322 that is optionally covered by a contact layer 360. A depression 324 is preferably formed in the upper surface 322 of the substrate 320 and the cavity thus formed is occupied by a wound spacer 340 that may be attached to the substrate 320. The wound spacer 340 is also preferably covered by the contact layer 360.

When the substrate 320 includes a moisture-cured resin, the wound spacer 340 may preferably be retained in the depression 324 by the moisture-cured resin that may, for example, migrate into the wound spacer 340 that is in contact with the substrate 320 during forming and curing. Alternatively, the wound spacer 340 may be retained within depression 324 by the contact layer 360 by, e.g., adhesion to the contact layer 360 and/or entrapment between the substrate 320 and the contact layer 360.

The wound spacer 340 may preferably extend across the width of the substrate 320 in the area of the distal metatarsal heads and proximal phalanges of the foot as seen in FIG. 6. Such a design may be particularly useful when the plantar ulcer or ulcers to be treated are in that region of the foot for which the footbed is being constructed. An additional advantage is that by extending the depression 324 across the width of the substrate 320, the overall stability of the footbed is improved as compared to footbeds with depressions that do not extend across the width of the footbed. Providing wound spacers and corresponding depressions that extend across the width of the substrate may also be advantageous where, for example, a wound spacer is provided in other areas of the foot such as the heel.

One illustrative method of constructing a custom footbed according to the present invention may be described in more detail as potentially, but not necessarily, including the following activities. Dress any wound present on the plantar surface of the foot for which a custom footbed is to be made. Apply a stockinet or other covering on the foot. Attach a wound spacer to the foot over the stockinet or other covering, locating a wound spacer over any wounds. The wound spacer may be trimmed to more closely conform to a desired shape relative to the size of the wound. Locate a toe spacer over the toes of the foot in the form of a toe envelope. This may involve construction of a toe envelope from, e.g., an adhesive-coated foam or other suitable material.

A piece of moisture-curable splinting/casting material used for the curable substrate is then provided and may include a liner on one or both sides thereof to reduce or eliminate migration of any moisture-curable resins out of the material during forming of the footbed. One suitable liner may be, e.g., a 100% polyester nonwoven material marketed under the tradename SONTARA (DuPont, Wilmington, Del.).

The foot with wound spacer and toe spacer attached is then placed on the liner and the outline of the foot is traced on the liner. It may be preferred that the tracing line be about 1 cm outside of the actual perimeter of the foot to provide a sufficient amount of curable substrate material such that the gutter 26 can be formed around the outside of the foot during the forming process.

After tracing the foot, the curable substrate is cut to the shape of the foot, the liner is removed, and, in the case of a moisture-curable substrate, the curing process may be initiated by immersing the curable substrate in water.

After initiating the curing process, the substrate is then placed on a compressible surface. If moisture-curable resins are impregnated in, e.g., a textile, it may be desirable to provide a barrier layer on the compressible surface to prevent migration of the resins into the compressible surface.

With the curable substrate in position, the foot is then pressed into the compressible surface to form the curable substrate. The patient then preferably stands on the foot such that the patient's weight provides the force used to form the substrate. It may also be desirable to provide a flexible sheet on the compressible surface underneath the curable substrate. That sheet can then be used to raise the edges of the substrate during forming to provide the desired gutter around the perimeter of the footbed. Pressure is preferably maintained for an amount of time sufficient to cure the substrate, e.g., four minutes for some moisture-curable splinting materials. After the substrate is cured sufficiently, the patient can remove his or her foot.

The upper surface of the cured substrate can then be covered by a contact layer which may be trimmed as desired. It may be preferred that the contact layer be adhesively attached to the substrate.

The finished custom footbed can be retained on the patient's foot by any suitable technique. In some instances, the footbed may be retained on the foot by a reusable custom device commonly referred to as a Roermond boot. Other alternatives for retaining the footbed in position may include any other suitable footwear capable of receiving the custom footbeds of the present invention.

All references and publications cited herein are expressly incorporated herein by reference in their entirety into this disclosure. Illustrative embodiments of this invention are discussed and reference has been made to possible variations within the scope of this invention. These and other variations and modifications in the invention will be apparent to those skilled in the art without departing from the scope of this invention, and it should be understood that this invention is not limited to the illustrative embodiments set forth herein. Accordingly, the invention is to be limited only by the claims provided below.

What is claimed is:

1. A custom footbed for a foot, the footbed comprising:

a substrate comprising an upper surface formed to the contour of only a portion of the plantar surface of the foot, wherein the substrate comprises a uniform layer thickness;

a depression occupying a selected area of the upper surface of the substrate, wherein the upper surface of the substrate deviates from the contour of the plantar surface of the foot within the selected area occupied by the depression, and whereby the depression and the foot define a cavity; and a compressible wound spacer locate within the depression on the upper surface of the substrate.

2. A footbed according to claim 1, wherein the upper surface of the substrate is formed to the contour of a majority of the plantar surface of the foot.

3. A footbed according to claim 1, wherein the selected area occupied by the depression encompasses the distal metatarsal heads of the foot.

4. A footbed according to claim 1, wherein the wound spacer and depression extend across the width of the substrate.

5. A footbed according to claim 1, wherein the wound spacer is attached to the upper surface of the substrate.

6. A footbed according to claim 1, wherein the substrate comprises moisture-cured resin, and further wherein the wound spacer is attached to the substrate by the moisture-cured resin.

7. A footbed according to claim 1, further comprising a contact layer attached to the footbed over the upper surface of the substrate and the wound spacer.

8. A footbed according to claim 7, wherein the wound spacer is retained within the depression by the contact layer.

9. A footbed according to claim 7, wherein the contact layer comprises a shear-absorbing textile.

10. A method of constructing a custom footbed, the method comprising:

providing a curable substrate comprising curable material;

providing a compressible surface to support the curable substrate;

providing a wound spacer;

locating the curable substrate between the wound spacer and the compressible surface;

positioning the wound spacer at a selected location on the upper surface of the curable substrate between a foot and the substrate;

forming the curable substrate to the contour of a portion of the plantar surface of the foot, wherein the curable substrate deviates from the contour of the plantar surface of the foot within the selected location occupied by the wound spacer; and curing the substrate after forming;

wherein the curable substrate and the compressible surface extend over the entire length of the foot.

11. A method according to claim 10, wherein the curable substrate comprises a textile impregnated with the curable material, wherein the curable material comprises moisture curable resin.

12. A method according to claim 10, further comprising locating a toe spacer between the toes of the foot and the curable substrate before forming the curable substrate.

13. A method according to claim 10, wherein the wound spacer extends across the width of the substrate.

14. A method according to claim 10, wherein the wound spacer is retained on the substrate after curing.

15. A method according to claim 10, further comprising removing the wound spacer from between the foot and the substrate after curing.

16. A method according to claim 10, further comprising attaching a contact layer to the substrate after curing.

17. A method according to claim 10, wherein the wound spacer is retained on the substrate after curing, and wherein the method further comprises attaching a contact layer to the substrate after curing, such that the wound spacer is retained between the substrate and the contact layer.

18. A method according to claim 10, wherein the wound spacer has a higher compression modulus than the compressible surface.

* * * * *

UNITED STATES PATENT AND TRADEMARK OFFICE

CERTIFICATE OF CORRECTION

PATENT NO. : 7,264,604 B1
APPLICATION NO. : 09/693770
DATED : September 4, 2007
INVENTOR(S) : Joannes F. H. M. Schuren It is certified that error appears in the above-identified patent and that said Letters Patent is hereby corrected as shown below:

Title page, Column 2 (Other Publications)
Line 10, delete "Msnagement" and insert -- Management --, therefor.

Column 2
Line 56, delete "would" and insert -- wound --, therefor.

Column 9
Line 7, in Claim 1, delete "locate" and insert -- located --, therefor.

Signed and Sealed this

Sixth Day of May, 2008

JON W. DUDAS
*Director of the United States Patent and Trademark Office*